US005205337A

United States Patent [19]

Bozzo

[11] Patent Number: 5,205,337

[45] Date of Patent: Apr. 27, 1993

[54] STRUCTURE FOR HANGING CURTAIN ON CURVED FRAME

[76] Inventor: Romolo T. Bozzo, 775 King Street East, Hamilton, Ontario, Canada, L8M 1A7

[21] Appl. No.: 754,851

[22] Filed: Sep. 4, 1991

[51] Int. Cl.[5] ..... E06B 9/06

[52] U.S. Cl. ..... 160/84.1; 160/330; 160/368.1; 160/383; 52/288; 52/287

[58] Field of Search ..... 160/368.1, 330, 84.1, 160/383; 52/716, 717, 288, 287, 784, 783

[56] References Cited

U.S. PATENT DOCUMENTS

| | | | |
|---|---|---|---|
| 1,787,876 | 1/1931 | Sandman | 52/784 |
| 2,047,747 | 7/1936 | Schemmel | 52/783 X |
| 2,705,820 | 4/1955 | Torrence | 52/783 |
| 2,843,889 | 7/1958 | Keller | 52/716 X |
| 3,368,601 | 2/1968 | Gantert-Merz | 160/330 X |
| 3,590,754 | 7/1971 | Jakobsen | 52/784 X |
| 3,777,800 | 12/1973 | Susoev | 160/330 X |

FOREIGN PATENT DOCUMENTS

| | | | |
|---|---|---|---|
| 607983 | 11/1960 | Canada | 52/784 |

*Primary Examiner*—Blair M. Johnson
*Attorney, Agent, or Firm*—Rogers & Scott

[57] ABSTRACT

A flexible transverse-L cross-section support structure is capable of being mounted around curved edges of, for example, window frames, bed-head frames and table tops. The structure is specially suitable to receive one component of a flexible two component loop and hook fastening system which it is required will remain in a flat plane while the other arm of the support is bent in a curved plane. The first arm which carries the tape on its outer face is provided on its inner face, preferably about midway along its length, with a short relatively thick third arm extending parallel to the second arm to form a channel between them. It is now possible to bend a support so that the second surface is curved without unacceptable bending or buckling of the first arm and the supported tape out of the original flat plane.

8 Claims, 1 Drawing Sheet

STRUCTURE FOR HANGING CURTAIN ON CURVED FRAME

FIELD OF INVENTION

This invention is concerned with a new flexible support structure of transverse-L cross-section adapted, for example, to support flexible elongated tape that is one component of a two-component hook and loop fastening system.

REVIEW OF THE PRIOR ART

Hook and loop fastening systems, such as that sold under the trade mark "VELCRO", are now extensively used for fastening sheet materials to a support. Examples of such use as the fastening of a decorative removable skirt to the edge of a table, the fastening of curtains to the edge of a window frame, and the attachment of a decorative fabric facing to the edge of a bed headboard. For ease of application the loop component, in the form of an elongated flexible tape, preferably is pre-fastened to an external face of one arm of a plastic support strip of transverse-L cross-section, which is then fastened to the receiving edge using fasteners that pass through the other unoccupied arm of the strip.

The use of such a support strip is limited strictly to its application to a straight edge, since any attempt to bend the strip around a curve of sufficiently small radius, e.g. as is employed in the examples quoted above, causes buckling of one or both of the arms. The arm by which the support strip is attached to the supporting frame can be made flat by such attachment, but the free arm carrying the fastener component will then buckle out of the desired flat plane to an extent that it is unusable. The provision of a support structure of transverse-L cross-section that can be bent to these relatively small radii is therefore of considerable commercial value, owing for example to ease of application and the saving in time in applying the support strip and its pre-attached fastener component to the curved edge.

DEFINITION OF THE INVENTION

It is therefore the principal object of the invention to provide a new flexible support structure of transverse-L cross-section that can be bent so that one of its arms is curved to a relatively small radius without unacceptable buckling of the other arm out of the flat plane.

It is another object to provide such a support structure particularly suited for the support of one component of a flexible two component hook and loop fastening system.

In accordance with the present invention there is provided an elongate support structure of a flexible plastics material for hanging a curtain on a frame having a curved, substantially planar surface and a curved edge substantially at right angles to the planar surface, the support structure comprising:

a support arm having an outer face for supporting the curtain and an inner face disposed in use adjacent the planar surface of said frame;

a mounting arm disposed substantially at right angles to the support arm having an inner face disposed in use adjacent the curved edge of said frame, the mounting arm being adapted to receive fastenings for mounting the structure to said curved edge; and a stabilizing arm protruding from the inner face of the support arm extending in use between the planar surface of said frame and the support arm, and substantially parallel to the mounting arm, the stabilizing arm being shorter than the mounting arm and of thickness, length and spacing from the mounting arm to maintain the support arm substantially in a plane without perceptible buckling when the structure is bent to a curved configuration and attached to said frame.

A first portion of the support arm between the mounting and stabilizing arms may be thicker than a second portion thereof beyond the stabilizing arm, while the first portion of the support arm may taper to increase in thickness from the mounting arm to the stabilizing arm.

The support arm may taper outwardly from the stabilizing arm; the mounting arm may taper outwardly from its junction with the support arm; and the stabilizing arm may taper outwardly from its junction with the support arm, in the last-mentioned case the face of the stabilizing arm facing the mounting arm may be parallel to the mounting arm inner face and the taper of the stabilizing arm may be produced by inclination of the other face of the stabilizing arm.

The stabilizing arm may be disposed between one third and two thirds of the length of the support arm from the mounting arm, and preferably is disposed approximately half way of the length of the support arm from the mounting arm.

The length of the stabilizing arm may be between one third and two thirds the length of the support arm, and preferably is approximately one half of the length of the support arm.

The support arm may have a shallow recess in its outer face for receipt of a thin tape supported thereby.

Preferably the support structure as defined in the preceding paragraphs is used in combination with a thin flexible tape attached to the outer face of the support arm and comprising one component of a two component hook and fastening system.

DESCRIPTION OF THE DRAWINGS

Particular preferred embodiments of the invention will now be described, by way of example, with reference to the accompanying diagrammatic drawings, wherein:-

DESCRIPTION OF THE PREFERRED EMBODIMENTS

Figures 1, 2, 3:
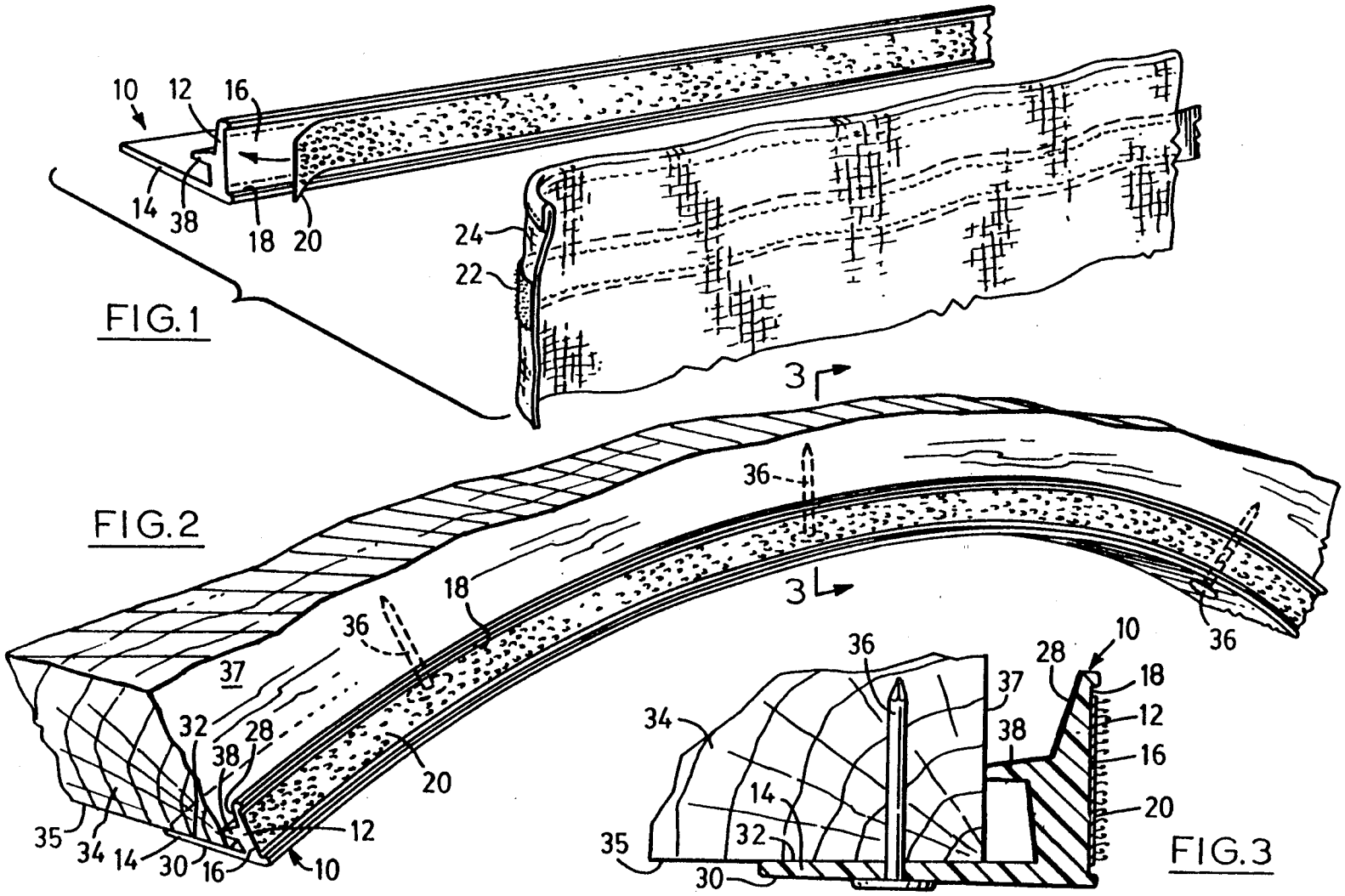
FIG. 1 is a perspective view of a support structure of the invention in straight configuration.
FIG. 2 is a perspective view of the support structure of FIG. 1 in bent, configuration applied to a curved edge.
FIG. 3 is a transverse cross-section of the structure of FIG. 2 taken on the line 3—3 in FIG. 2.

The support structure comprises an elongated strip 10 of plastics material, e.g. a filled PVC, having a first arm 12 for supporting a curtain 24 and a second arm 14 for mounting the strip 10, the two arms being disposed at right angles to one another. The first arm 12 is provided across its full width at its outer face 16 with a shallow recess 18 in which is mounted, e.g. by glueing, a tape 20 constituting a component of a two component hook and loop fastening system. This component is usually the hook portion of the system, the other component comprising a loop-carrying tape 22 attached, for example to the piece of curtain material 24 that is to be fastened in place by the system. The first arm 12 has outer and inner faces 16 and 28 respectively, while the second arm 14 has outer and inner faces 30 and 32 respectively; with a transverse-L configuration the two outer faces 16 and 30 may be regarded as being on the convex side while the two inner faces 16 and 32 are regarded as being on the concave side.

It is required that the support 10 can be fastened to a curved edge 35 of a body 34 which is, e.g. a curved window frame, bed head frame or table top, as by use of fastenings 36, with the second arm 14 bending smoothly in a perspective curved plane to conform to this curvature, while the first arm 12 must remain in a flat plane without any perceptible buckling.

I have found that it is possible to provide a support structure having this highly desirable characteristic by adding a third arm 38 to the inner face 28 of the first arm for stabilizing the first arm upon bending of the structure, with this third arm extending therefrom a short distance spaced from and generally paralled to the second arm. Both the first and the second arms taper from their common junction to decrease in thickness along their respective widths. In addition, a first portion of the first arm between the second and third arms is thicker than a second portion therof beyond the third arm, this first thicker portion tapering to increase in thickness from the second arm to the third arm. The third arm also tapers outwardly from its junction with the first arm to decrease in thickness, and this taper is produced by the face of the third arm facing the second arm inner face 32 being substantially parallel to that inner face, while the other face of the third arm is suitably inclined. These physical characteristics are at present believed to assist in the functioning of the invention. It will be noted that with the support 10 fastened to the body 34 the end of the third arm 38 buts against the flat surface 37 of the body to prevent inward inclination of the first arm 12.

The third arm 38 should be spaced from the second arm 14 between one and two thirds of the length of the first arm 12, and preferably as illustrated is spaced approximately half of the length of the first arm from the second arm. The third arm need not be too long and is also between one and two thirds of the length of the first arm, preferably about half its length. The first arm cannot be too long or perceptable buckling will begin to be obtained, whereas the length of the second arm is much more variable since it is able to bend easily through its thin dimension. It is found that upon bending the unsupported support strip the angle between the two arms 12 and 14 increases a few degrees from ninety degrees, but this small amount of "splay" is corrected when the support is fastened securely to the right-angled rigid edge; it could be corrected if required by making the angle between the arms slightly smaller than ninety degrees.

It will be seen that the parallel second and third arms and the connecting first thicker portion of the first arm form a channel, the side walls of which formed by the second and third arms bend relatively easily in their respective planes without the intervening bottom web buckling, and also without buckling of the thinner portion of the first arm that protrudes beyond the channel bottom web. Such a support structure is easily produced commercially in whatever length is required by extrusion of suitable plastics material through a correspondingly-shaped die.

In a particular embodiment the overall length of the first arm 12 is 13 mm while the channel 18 is 10 mm wide and about 0.5 mm deep; the arm is 2.5 mm thick at its junction with the second arm 14 and increases in thickness to 3.0 mm at its junction with the third arm 38, the second portion of the first arm is only 1.5 mm thick at its junction with the third arm and tapers down to about 1 mm at its free edge. The third arm 38 is approximately at the centre of the first arm and is 2 mm thick at its junction with the first arm, tapering down to about 1 mm at its free edge; its length to the first thicker portion of the first arm is 3 mm, while its length to the second thinner portion is 4.5 mm. In this embodiment the second arm 14 is 22 mm long, tapering from a tickness of about 2 mm at its junction with the first arm 12 to about 1 mm at its free edge. Suprisingly it is found that a piece of such a support of about 100 cm length can be bent to a radius as small as 20 cm without displaying unacceptable bending or buckling of the first arm out of its original flat plane; the limit of the bending curvature that can be obtained appears to be almost to the point at which the somewhat stiff filled polyvinylchloride plastics material will break, so that more curvature should be obtainable with a more flexible unfilled material. It should be noted that when using the word curtain, any commonly hung item is intended to be within its scope, such as fabric, beads, rope, etc.

What I claim is:

1. In a frame having an arched surface and a support structure attached to the frame for hanging a curtain therefrom, the improvement in which the support structure is made of flexible plastics material and the structure comprises:

a support arm having two ends and an inner and an outer face, the outer face having means to support the curtain;

a mounting arm disposed substantially at right angles to the support arm at one end thereof and adapted to receive fastenings for mounting the mounting arm to said arched surface and whereby said mounting arm is bent to conform to said arched surface; and a stabilizing arm extending from the inner face of the support arm and substantially parallel to the mounting arm, the stabilizing arm being shorter than the mounting arm and of thickness, length and spacing from the mounting arm to maintain the support arm substantially in a flat plane without perceptible buckling when the mounting arm is bent to a curved configuration.

2. A support structure as claimed in claim 1, wherein the length of the stabilizing arm is between one third and two thirds the length of the support arm.

3. A support structure as claimed in claim 1, wherein the stabilizing arm is disposed between one third and two thirds of the length of the support arm from the mounting arm.

4. A support structure as claimed in claim 1, wherein a thin flexible tape is attached to the outer face of the support arm, the tape being one component of a two component hook and fastening system for attaching the curtain to said support arm.

5. In a frame having an arched surface defining a curved edge substantially at right angles to a planar surface and a support structure attached to the frame for hanging a curtain therefrom, the improvement in which the support structure is made of flexible plastics material and the structure comprises:

a support arm having two ends and an inner and an outer face, the outer face having means to support the curtain and the inner face disposed adjacent the planar surface of said frame;

a mounting arm disposed substantially at right angles to the support arm at one end thereof and adapted to receive fastenings for mounting the mounting arm to said arched surface and whereby said mounting arm is bent to conform to said arched surface; and a stabilizing arm extending from the inner face of the support arm between the planar surface of said frame and the support arm, and substantially parallel to the mounting arm, the stabilizing arm being shorter than the mounting arm and of thickness, length and spacing from the mounting arm to maintain the support arm substantially in a flat plane without perceptible buckling when the mounting arm is bent to a curved configuration.

6. A support structure as claimed in claim 5, wherein the length of the stabilizing arm is between one third and two thirds the length of the support arm.

7. A support structure as claimed in claim 5, wherein the stabilizing arm is disposed between one third and two thirds of the length of the support arm from the mounting arm.

8. A support structure as claimed in claim 5, wherein a thin flexible tape is attached to the outer face of the support arm, the tape being one component of a two component hook and fastening system for attaching the curtain to said support arm.

* * * * *